United States Patent [19]

Gustavsson et al.

[11] 4,007,678

[45] Feb. 15, 1977

[54] COMPACTOR PRESS ASSEMBLY

[75] Inventors: John Kenneth Crister Gustavsson; Björn Christer Sjögren, both of Savsjo, Sweden

[73] Assignee: Aktiebolaget Electrolux, Stockholm, Sweden

[22] Filed: June 11, 1975

[21] Appl. No.: 585,850

[30] Foreign Application Priority Data

June 13, 1974 Sweden ..... 7407788

[52] U.S. Cl. ..... 100/52; 100/229 A; 100/290

[51] Int. Cl.² ..... B30B 15/14

[58] Field of Search ..... 100/52, 289, 290, 229 A

[56] References Cited

UNITED STATES PATENTS

| | | | |
|---|---|---|---|
| 3,659,427 | 5/1972 | Harza | 100/290 |
| 3,727,546 | 4/1973 | McKinney | 100/289 |

*Primary Examiner*—Billy J. Wilhite

*Attorney, Agent, or Firm*—Alfred E. Miller

[57] ABSTRACT

A household compactor mechanical press structure for refuse provided with a screw with a relatively large pitch having a piston attached to one end thereof. The screw runs through a threaded hole in a vertically movable structure that is supported by a pair of threaded rods. The latter are rotatably journalled at one end in a support plate and at the other end pass through threaded holes in the vertically movable structure.

10 Claims, 7 Drawing Figures

COMPACTOR PRESS ASSEMBLY

BACKGROUND OF THE INVENTION

Household kitchen compactors are known which receive refuse and compresses it to a certain restricted volume. These compactors are generally box-shaped and are of such dimensions that they fit under a kitchen counter. The compactor has a refuse-receiving drawer which can be pulled out and retracted into the unit. Thus, the unit may have a retractable door provided with a bed plate supporting a waste container. When the door is in a closed position, a press assembly including a compacting piston, can be activated to compress the waste material in a direction toward the bed plate. Furthermore, it is desirable in apparatus of this type to utilize a compact press assembly that permits the piston to be entirely removed from the container when the door and the bed plate are removed from the structure.

Another requirement of the so-called household kitchen compactor is that the piston is capable of a long stroke that permits it to move far down in the container and in proximity to the bed plate. Furthermore, it is also desirable to provide a compactor that is relatively inexpensive to manufacture.

Thus, previous constructions, such as the hydraulically actuated piston mechanism in a compactor, have been found to be too expensive to be suitable. Moreover, mechanical-electrical systems, using a rotary screw as the motive means for the piston, have not proved to be satisfactory since it is difficult to obtain a sufficient stroke length of the screw within the available limited space. In addition, the previous known constructions were subject to a relatively slow compressing cycle.

SUMMARY OF THE INVENTION

The present invention relates to a press assembly for a household compactor in which the piston housed in a support structure is moved upwardly and downwardly by means of a screw that is rotatably mounted in the piston.

It is an object of the present invention to provide a compact press assembly for a household compactor that can be contained in a limited space.

Another object of the present invention is to provide an inexpensive assembly including a rotatable screw and a piston operating in a household compactor that achieves the desirable result.

A further object of the present invention is to provide a mechanical screw arrangement for the compressing piston which operates relatively rapidly.

It is another object of the present invention to provide a vertically movable part in the compactor housing supported by a pair of threaded rods. The part is further provided with a threaded hole in which the screw carrying the piston is screwconnected.

The invention will now be more fully described with reference to the accompanying drawings in which.

DESCRIPTION OF THE PREFERRED EMBODIMENT

Figure 1:
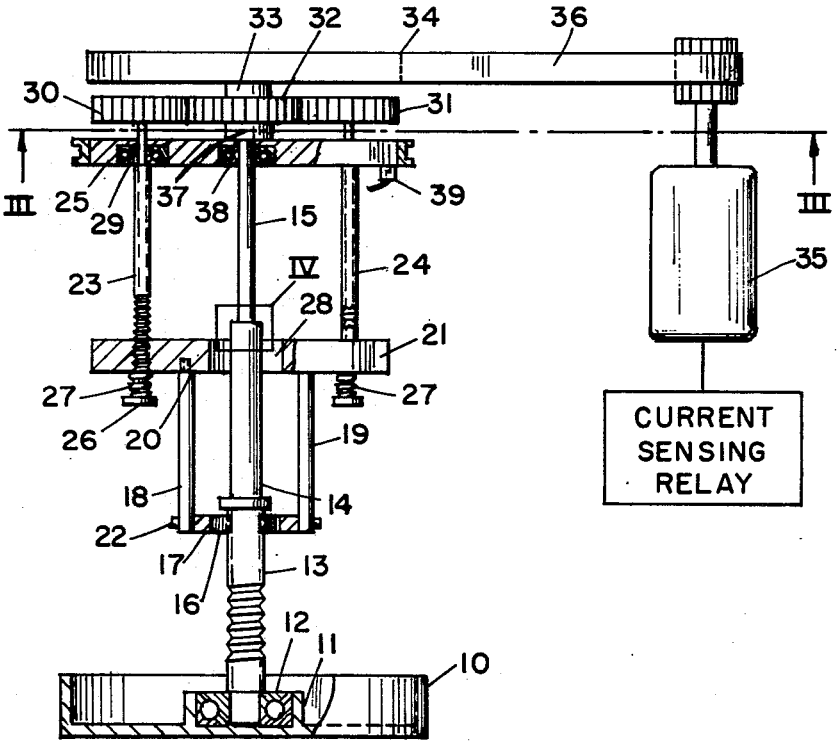
FIG. 1 is a front elevational view, partly in section, of the compactor press assembly and associated structure constructed in accordance with the teachings of the present invention.
Figure 3:
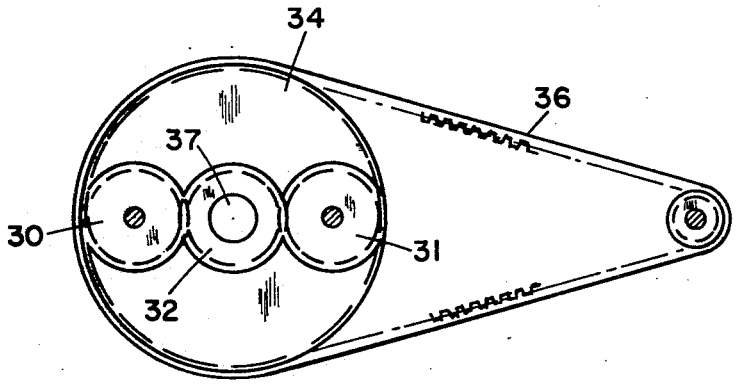
FIG. 3 is a section taken along the lines III—III of FIG. 1.
Figure 2:
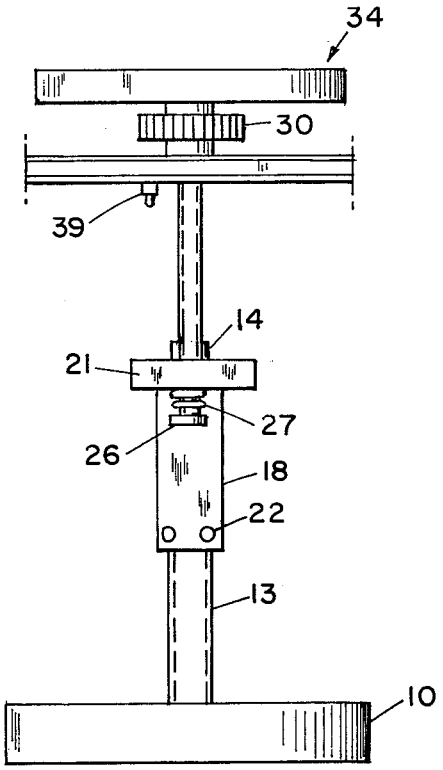
FIG. 2 is a side elevational view of the assembly shown in FIG. 1.

A press assembly comprising a circular piston 10 is shown in detail in FIGS. 1 and 2. The piston is adapted to be moved vertically and when moved in a downward direction the waste present in the receptacle of the compactor (not shown) is compacted against a bed plate (not shown). The bed plate forms the bottom surface of a front part of the compactor that is retractable from the assembly. The piston 10 is provided with a central cup 11 which houses a taper roller bearing 12. The inner ring of the bearing 12 is secured to an end of the vertical screw 13. The latter is provided with a comparatively large pitch.

Operatively connected to the screw 13 are two shafts 14 and 15 which are adapted to telescope, as well as rotate, to thereby cause the screw 13 to run in the threaded hole 16 of the spacer element 17. It should be evident that the rotation of the screw 13 causes the piston 10 to move vertically relative to the spacer 17. The direction of movement of the screw is determined by the direction of the rotation of the screw 13.

The spacer 17 is a solid construction of rectangular cross-section and it is connected to a yoke 21 by means of two spaced vertical bars 18 and 19, each of which has a threaded end 20. As seen in FIG. 1, the bars 18 and 19 are fixed to the space 17 by means of screws 22 and are rectangular in cross-section, similar to the configuration of the spacer 17.

The yoke 21 is operatively connected to the plate 25 by means of two, spaced, threaded rods 23 and 24 having a comparatively small pitch. It will be noted that the plate 25 forms part of the support structure of the press assembly and the threaded rods 23 and 24 extend into the corresponding threaded holes in the yoke 21. Thus, the uniform rotation of the rods causes the yoke 21 to move vertically. The extreme lower end of each of the rods 23 and 24 is provided with a flange 26 which supports a coil spring 27 between said flange and the yoke 21. The upper end of each coil spring 27 abuts the underside of the yoke 21.

An opening 28 of a size sufficient to permit the shaft 14 and the screw 13 to move freely through the yoke 21 is shown in FIG. 1. Furthermore, the threaded rods 23 and 24 are journalled in their top ends in angular contact ball bearings 29 fitted in the plate 25 so that the plate is capable of absorbing the axial forces to which the rods 23 and 24 are subjected.

The extreme upper ends of the threaded rods 23 and 24 are connected to cylindrical gear wheels 30, 31 that are driven by an interposed pinion gear 32. The latter gear is rigidly attached to a short shaft 33 which is connected at the other end to a drive gear 34. An electric motor 35 drives the gear 34 via a transmission belt 36.

The pinion gear 32 is further connected to the shaft 15, however, by means of a sliding coupling 37 mounted in the hub portion of the pinion gear 32. Accordingly, the shafts 14 and 15 can transmit only a certain limited driving moment to the screw 13. The shaft 15 is shown journalled in the plate 25 by means of a roller bearing 38.

As seen in FIGS. 1 and 2, the press assembly for the compactor piston includes a microswitch 39 which is dependent from the plate 25. The microswitch functions to disconnect the motor 35 when the yoke 21 has reached its upper position adjacent to the plate 25.

Figure 4:
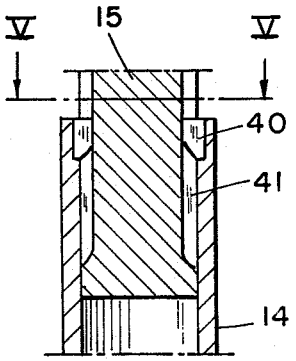
FIG. 4 is a sectional view on an enlarged scale of the part bearing the reference numeral IV of FIG. 1
Figure 5:
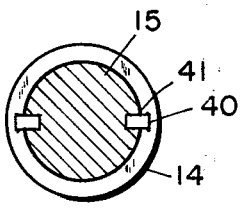
FIG. 5 is a sectional view taken along the lines V — V of FIG. 4.

Referring to FIGS. 4 and 5, a shaft 14 is illustrated which is tubular, so that the shaft 15 can move axially within the shaft 14 simultaneously as the turning torque is transmitted by means of the wedges 40 mounted in the shaft 14 and adapted to slide in the axial grooves 41 in the shaft 15. Moreover, the connection between the shaft 14 and the screw 13 is the same.

The mode of operation of the present press assembly for a compactor piston is as follows: The waste material to be compacted is placed in the container in the retractable front part of the household compactor in its extended position. Then the front part is retracted into the compactor housing and a microswitch (not shown) is actuated which initiates the compression cycle of the compactor. Thus, when desired, the motor 35 is rendered operative and a force is transmitted to the threaded rods 23 and 24 as well as to the screw 13 via the transmission belt 36, the drive gear 34, the gears 32, 30 and 31 and the shafts 14 and 15.

When the threaded rods 23 and 24 are rotated, the yoke 21 is lowered which results in the lowering of the screw 13. At the same time, the screw 13 is lowered while rotating, thus superposing its vertical movement of the yoke 21, whereby the piston 10 is caused to move rapidly in a downward direction. When the piston 10, moving downwardly, contacts the waste material, the latter is compressed by the co-action of the threaded rods 23 and 24 and the screw 13. When the resistance on the piston increases, the sliding coupling 37 is engaged. This causes the screw 13 to stop its downward movement whereas the threaded rods 23 and 24 continue their movement during the last part of the compression stroke. During the first part of the stroke when there is no resistance, or only a small resistance to the piston, and because the pitch of the threaded rods 23 and 24 is small relative to that of the screws 13, the piston 10 will move down rapidly, whereas during the last part of the compression cycle, it will move down comparatively slowly. This construction and arrangement results in a very advantageous compression cycle.

It is desired to state that the maximum compression in the system is sensed by a so-called power relay in the electric circuit of the motor 35. The relay senses the current or the power of the motor and at a given value, corresponding to a given load on the motor, it reverses the motor so that the piston 10 moves upwardly under the action of both of the threaded rods 23 and 24 as well as the screw 13. However, when the yoke 21 has reached its upper position, the microswitch 39 is acted upon to disconnect the power source to the motor 35.

A safety device for the apparatus acts to put a sufficient load on the motor 35 when there is not waste in the container of the compactor, or when the waste level is too low, in order to cause sufficient resistance to the piston. The assembly is so designed that the yoke 21, when it reaches its bottom end position, will compress the coil springs 27. Thus, the motor 35 will be exposed to a linearly increasing resistance which causes the motor to reverse when the current through the motor, as preset, has been reached.

Figure 6:
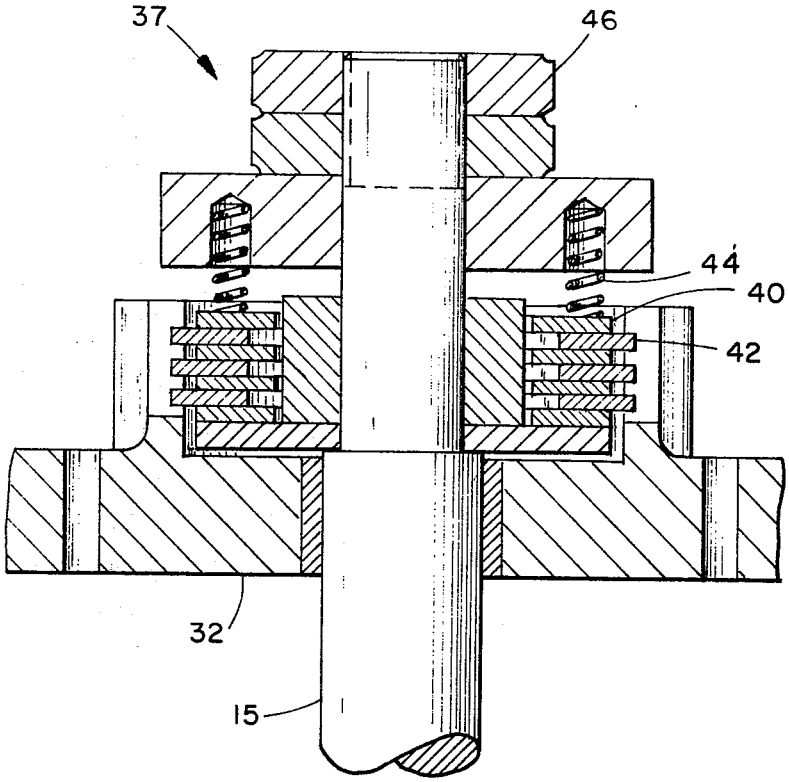
FIG. 6 is an enlarged sectional view of the sliding coupling.
Figure 7:
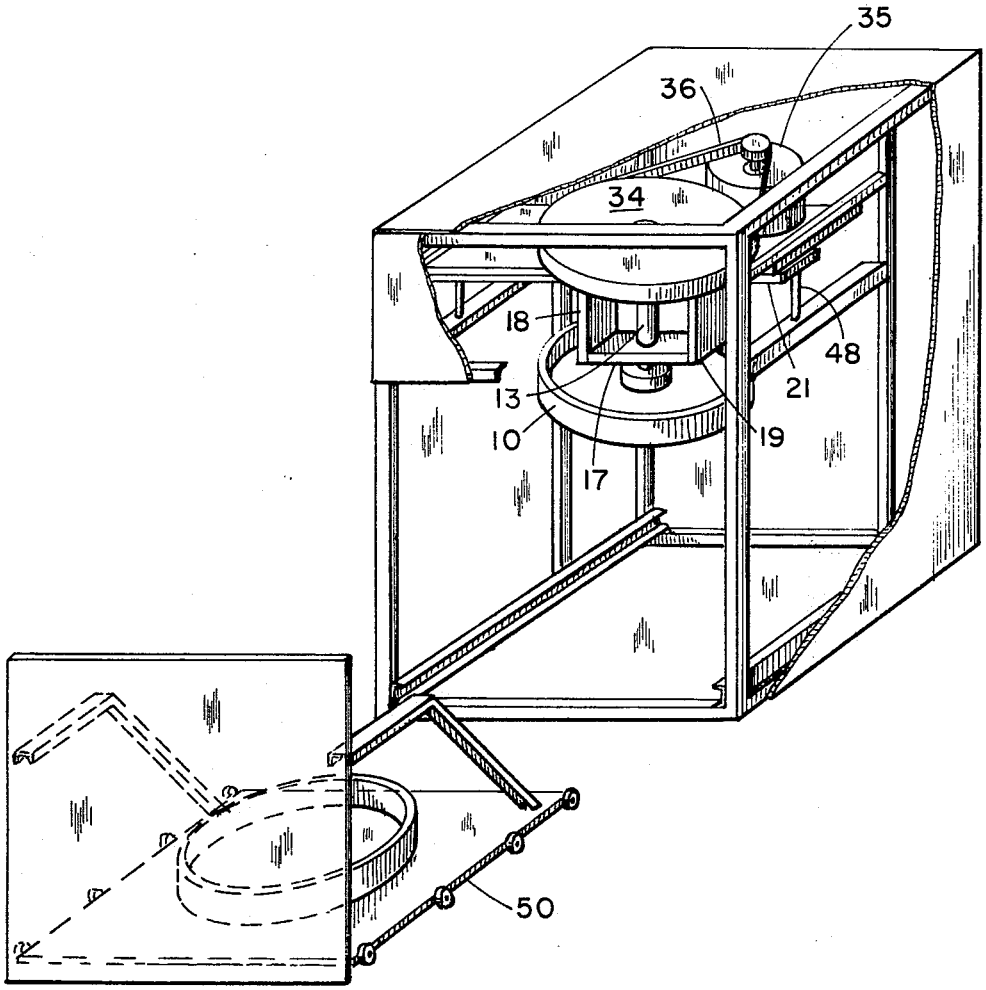
FIG. 7 is a perspective of the entire assembly with a part thereof broken away for purposes of clarity.

The slide coupling referred to generally by the numeral 37 is a well-known friction type coupling having inner and outer discs 40 and 42 respectively. The inner discs 40 are in engagement with the shaft 15 while the outer discs 42 are in engagement with the pinion 32. Springs 44 are shown whereby the turning movement of the sliding coupling 37 may be easily increased by compression of the springs 44 by tightening the nuts 46. All of the above-described structure is clearly shown in FIG. 6 of the drawings. Referring now to FIG. 7, in which a press support structure is shown having a yoke 21 with a hole or opening. On each side of the hole or opening are located cylindrical guides 48 for the yoke. It will be noted that these guides are rigidly secured to the support structure. Furthermore, a lower bed plate is shown to be constructed in such a manner as to constitute a carriage 50 that is adapted to be movable in and out of the support structure.

The present construction and arrangement of a houshold compactor achieves the desirable result of providing a unit which is inexpensive to construct and can be used in a limited space, such as under a kitchen counter, while operating in a relatively rapid manner.

What is claimed is:

1. A compactor press assembly provided with a support structure having a lower bed plate comprising a piston adapted to be moved up and down relative to said support structure, a screw rotatably mounted in said piston, a pair of telescoping drive shafts, a drive means connected to one end of one of said drive shafts and said screw being connected to another end of said drive shafts, an upper support plate rigidly connected to said support structure of the assembly, a vertically movable part having a plurality of threaded holes, a spacer element connected to said vertically movable part and provided with a threaded hole, a pair of threaded rods each in engagement with a respective threaded hole in said vertically movable part, one end of each of said rods being journalled in said upper support plate, said part upon rotation of said threaded rods being movable vertically whereby said screw runs through the threaded hole in said spacer element thereby causing movement of said piston.

2. A compactor press assembly as claimed in claim 1, wherein said vertically movable part includes a yoke, and means connecting said yoke and said spacer element.

3. A compactor press assembly as claimed in claim 1, wherein said threaded rods and said screw are disposed in substantially the same plane, said screw being located between said rods, and wherein said drive means includes a plurality of interengaging gear wheels for said screw and said rods, the gear wheel for said screw acting as the driving means for the gear wheels of said rods.

4. A compactor press assembly as claimed in claim 3 wherein at least one of said telescoping drive shafts operatively connects the gear wheel for said screw to said screw, said shaft being capable of transmitting rotary movement to said screw.

5. A compactor press assembly as claimed in claim 4 wherein said two telescoping drive shafts are provided with means to permit both linear and rotary movement thereof.

6. A compactor press assembly as claimed in claim 3 further comprising a sliding coupling positioned between said gear wheel of the screw and said screw.

7. A compactor press assembly as claimed in claim 1, wherein the pitch of the threads of the screw is greater than the pitch of the threads of said rods.

8. A compactor press assembly as claimed in claim 3 further comprising an electric motor, and a transmission means connecting said motor to said screw for driving the latter.

9. A compactor press assembly as claimed in claim 8, wherein each of said threaded rods is provided with a free end having a shoulder at its extremity, a coil spring surrounding each of said rods and engaging said shoulder at one end thereof and an undersurface of said vertically movable part at the other end thereof, said springs providing a resistance to the driving of the electric motor during the movement of a section of said vertically movable part toward said shoulder.

10. A compactor press assembly as claimed in claim 8 further comprising a current sensing relay connected to said motor which reverses the motor when the load exceeds a given value.

* * * * *